US006343710B1

(12) United States Patent
Rubin

(10) Patent No.: US 6,343,710 B1
(45) Date of Patent: Feb. 5, 2002

(54) BARREL-LIKE CONTAINER WITH COVER DESIGNED FOR COMPLETE DRAINAGE

(76) Inventor: David Rubin, 8949 Montrose Way, San Diego, CA (US) 92122

( * ) Notice: Subject to any disclaimer, the term of this patent is extended or adjusted under 35 U.S.C. 154(b) by 0 days.

(21) Appl. No.: 09/685,691

(22) Filed: Oct. 11, 2000

(51) Int. Cl.[7] ..... B65D 5/00
(52) U.S. Cl. ..... 220/571; 220/4.05; 220/601
(58) Field of Search ..... 220/571, 601, 220/4.04, 4.05, 567.2, 4.12, 4.13, DIG. 1

(56) References Cited

U.S. PATENT DOCUMENTS

| | | | | |
|---|---|---|---|---|
| 1,342,299 A | | 6/1920 | Shaw | |
| 2,974,826 A | | 3/1961 | Martin | |
| 3,160,312 A | | 12/1964 | Johnston | |
| 3,279,640 A | | 10/1966 | Dodson | |
| 3,647,110 A | | 3/1972 | Hammes | |
| 3,827,595 A | | 8/1974 | Reynolds | |
| 3,940,013 A | | 2/1976 | Bonnett | |
| 3,952,904 A | * | 4/1976 | Verlinden | 220/4.05 |
| 4,023,679 A | | 5/1977 | Hammes | |
| 4,767,021 A | | 8/1988 | Pies | |
| 4,846,369 A | | 7/1989 | Dunstan | |
| 5,007,565 A | | 4/1991 | Richter et al. | |
| 5,014,873 A | * | 5/1991 | Clemens et al. | 220/4.05 X |
| 5,044,510 A | * | 9/1991 | Schutz | 220/4.05 |
| 5,071,028 A | * | 12/1991 | Murphy | 220/4.05 X |
| 5,184,751 A | * | 2/1993 | Middleton | 220/601 X |
| 5,199,570 A | * | 4/1993 | McKenzie | 220/4.05 X |
| 5,199,613 A | | 4/1993 | Magrath et al. | |
| 5,975,338 A | | 11/1999 | Przytulla et al. | |

* cited by examiner

*Primary Examiner*—Steven Pollard
(74) *Attorney, Agent, or Firm*—Browdy and Neimark

(57) ABSTRACT

A container has a body with side walls and a bottom, as well as a cover connected to the side walls but below the rim. The cover is shaped as an offset dome or a sloped roof such that the bung is adjacent a side wall and at the highest point of the cover when the container is upright. A ridge runs from the bung to the side wall diametrically opposite the bung, thereby creating a downward slope from the ridge to the line of intersection of the cover with the side walls. The line of intersection of the cover with the side walls may be horizontal or at a slight angle upwardly to the position of the bung. An air tube may be placed within the bung and extend to the point of intersection of the side wall with the bottom which is farthest from the position of the bung. An alternative air tube or a second air tube may be placed within the bung and extend to the point of intersection of the side wall with the cover which is farthest from the position of the bung.

11 Claims, 3 Drawing Sheets

BARREL-LIKE CONTAINER WITH COVER DESIGNED FOR COMPLETE DRAINAGE

FIELD OF THE INVENTION

The present invention is related to a container with a cover constructed to allow complete drainage of the container contents, and thus reduce drainage residue.

BACKGROUND OF INVENTION

The complete drainage of containers is very important for many reasons. Due to the increasing usage of containers as multi-use vessels, ever greater amounts of drainage residues are produced. Chemical and pharmaceutical manufacturers and researchers use expensive reagents and chemicals delivered in containers. Because the containers do not allow near-complete emptying, research and production costs increase as it is necessary to purchase more reagent chemicals to replace the residue. When hazardous materials are used, residues, brought about by containers that do not allow complete emptying, have a detrimental effect on the environment as they are simply thrown away as waste, which accumulates as more material is purchased to make up for the residue. For example, residue in a 50-gallon drum that does not allow near-complete emptying can total about 500–700 cc of the fluid material.

The steps previously taken to solve this problem have not been satisfactory. With existing designs, in order to obtain residual fluid through the fill and drainage bung of the container, the user must resort to turning the container upside down and moving it back and forth to try to get the residual fluid into the aperture of the bung. However, it is not possible to obtain an adequate drainage of residue in this manner.

According to one previous design, U.S. Pat. No. 4,767,021, a barrel having a specially designed top head has been developed, in which the residual fluid is collected and guided to the aperture of the bung. For this purpose, a segmented portion of the upper end of the barrel is indented and sloped inward to the body of the barrel. When the barrel is tipped upside down, the residual liquid flows on the inside of the flattened portion towards the barrel wall to the bung housing and out of the barrel through the bung socket. Even though appreciable improvements have been achieved, additional handling of the container is still required and a very complex cover must be provided.

U.S. Pat. No. 4,767,021 at FIG. 5 shows an embodiment of a drum design with one bung. However, in a drum design containing only one bung, there is a splashing effect during the outpouring of the fluid from the container, caused by the displacement of air in the container. The splashing effect prevents all the fluid from being transferred to another holder, container, or medium, but rather an amount of the fluid material falls on surfaces in the surrounding area. This leads to a waste of fluid material, which can be an environmental hazard (if the fluid material is hazardous), and drive up expenses (as additional fluid material may have to be purchased).

SUMMARY OF THE INVENTION

Accordingly, it is an object of this invention to provide a container which solves the problems of the prior art.

It is another object of the present invention to provide a container that allows approximately complete emptying of the container with a relatively simple cover shape.

It is yet another object of this invention to avoid additional manipulation of a container in an effort to completely empty the container once it has been inverted.

It is a further object of this invention to provide a container which reduces environmental pollution by reducing the amount of residue left in the container after emptying.

It is a still further an object of this invention to reduce the cost of reagents used in research by allowing researchers to use approximately all of the fluid material.

It is yet a further object of this invention to reduce the amount of splashing associated with pouring fluid material from a container with one bung.

Pursuant to the present invention, these objects are accomplished by providing a container having a bung which is arranged on the cover or lid portion of the container at a position adjacent the rim of the wall of the container, either adjoined to the rim or immediately adjacent thereto with only a relatively small space therebetween. Furthermore, the cover of the container is designed such that, when the drum is inverted, the bung is at a level which is lower than any other point on the cover.

The cover may intersect with the side walls on a horizontal plane as is conventional, or it may intersect at a slight angle such that in an inverted drum the bung is at the edge of the cover which is farthest down.

The cover is designed with a crease extending from the bung across the center of the lid to the opposite side. In the embodiment in which the intersection of the lid with the container is on a horizontal plane, the lid will achieve the shape of an offset dome with the high point (when the container is upright) at the aperture of the bung very near to the side wall. Thus, there will be a sharp angle to the bung in the very small space between the bung and the wall, with a very gentle slope from the remainder of the points of intersection of the cover with the side walls to the aperture of the bung. The slight crease in the lid along the diameter from the bung to the opposite side further aids in channeling the liquid within the container to the bung when the container is tipped or inverted.

In the embodiment in which the plane of intersection of the cover with the drum is sloped, the bung may be adjoined to the rim. There is still preferably a slight dome-shaped element leading to the aperture of the bung so that a crease can also be placed in the cover along the diameter from the bung to the opposite side, as described above for the first embodiment.

In order to further conserve the liquid stored within the container, and protect the user from its potential toxicity or caustic properties, a device is provided to prevent the splashing of liquid as air is forced to enter the bung upon pouring of the liquid from the container. For this purpose, a small pipe or tube is placed in the bung aperture which extends to a point at the bottom of the container which is diagonally opposite the edge of the container at which the bung is located. Preferably, the pipe or tube extends from the side of the bung aperture farthest from the rim, along the ridge to the point at the underside of the cover which adjoins the wall of the container opposite the position of the bung, and then proceeds directly downwardly along the inner side wall of the container to a point substantially adjacent the floor of the container, while being spaced therefrom far enough to avoid occlusion of the opening of the pipe or tube by the floor of the container. In this way, when the container is being tilted to pour liquid out of the bung aperture, particularly when being tilted more than 90° from the vertical, air will enter the tube and replace the liquid, thus avoiding the gurgling that would normally occur. In another embodiment, the device for preventing splashing is a short tube placed inside the bung aperture, directed to the area of the intersection of the cover with the side wall furthest from the bung. In this way, when the container is full and begins to pour, particularly as it is tilted from the vertical up to an angle of 90°, air is allowed to flow through the short tube into the upper portion of the container, thus preventing gurgling. In yet another embodiment, both a long tube and a short tube may be present, the long tube being directed to a point substantially adjacent to the floor of the container diagonally opposite the bung, and the short tube directed to the area of the intersection of the cover with the side wall diametrically opposite the bung. In this way, when the container is full and begins to pour, until it reaches an angle of 90° from the vertical, air will flow through the short tube to the area at the top of the container from which liquid is being displaced, thus preventing gurgling, and when the tilt is greater than 90° from the vertical, air is allowed to enter the long tube and replace the liquid being displaced from the bottom of the container, which is now uppermost, thus avoiding the gurgling that would normally occur.

DETAILED DESCRIPTION OF THE INVENTION

Figure 1:
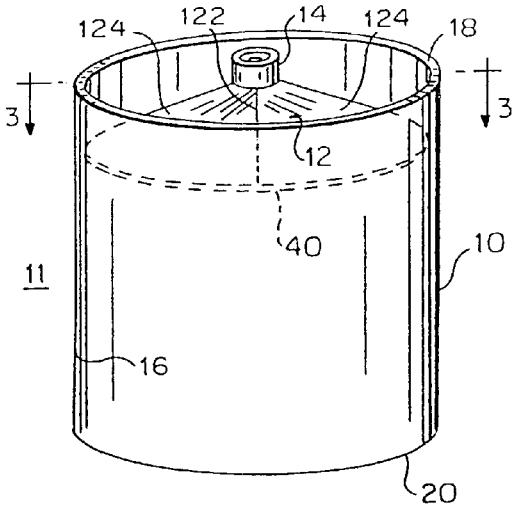
FIG. 1 shows a rear perspective view of a container according to a first embodiment of the present invention.

It will be noted here that the term container is used herein in a broad sense to embrace various forms of barrel-like containers including drums, gasoline jericans, casks, and the like.

Referring firstly to the embodiment illustrated in FIGS. 1–6, the container 11 consists of a body 10, a cover 12, and a bung 14. The container 11 can be any volume.

The body 10 can be made of any material, preferably of plastic, or metallic material. While the preferred shape, as shown, is cylindrical, any other shape of horizontal cross-section may also be used. The body 10 consists of side walls 16, including a rim 18, and a bottom 20.

The cover 12 features a bung 14 very close to the 15 rim 18 of the side wall 16. It is either arranged against the rim 18, as in the embodiment of FIGS. 7–12, or immediately adjacent the rim 18, as in the embodiment of FIGS. 1–6. The cover 12 is defined by a ridge 122, and two sides 124 arranged on either side of the ridge 122. The ridge is sloped at an angle $\alpha$ to the horizontal of about 1–10°, preferably about 1–5°. The slope of the ridge as shown in the figures is exaggerated for illustrative purposes. The bung 14 is positioned at one end of the cover 12 along the ridge 122 at the highest (when the container is upright as in FIGS. 1–5) point of the ridge 122. The intersection 40 of the cover 12 with the wall 16 of the container 11 is horizontal in the embodiment of FIGS. 1–6. Preferably, the intersection 40 of the cover 12 with the wall 16 is far enough below the upper edge of the rim 18 such that the entire bung, and any cap therefor (not shown) will be maintained below the top edge of rim 18, thus allowing the container to be stackable. Otherwise, the intersection 40 should be as close as possible to the upper edge of rim 18, or, preferably, flush with the upper edge of the rim 18.

Figure 2:
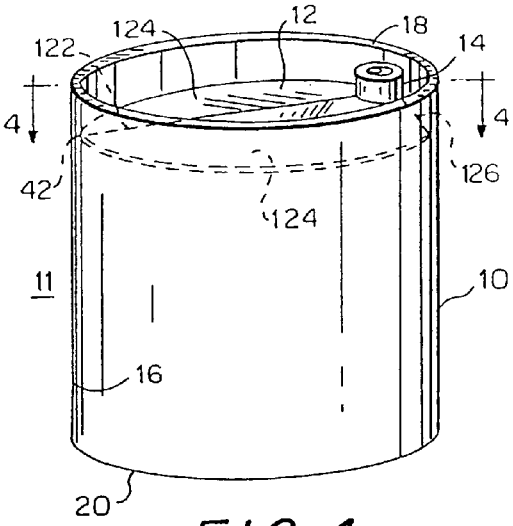
FIG. 2 shows a side perspective view of the container of the embodiment of FIG. 1.
Figure 3:
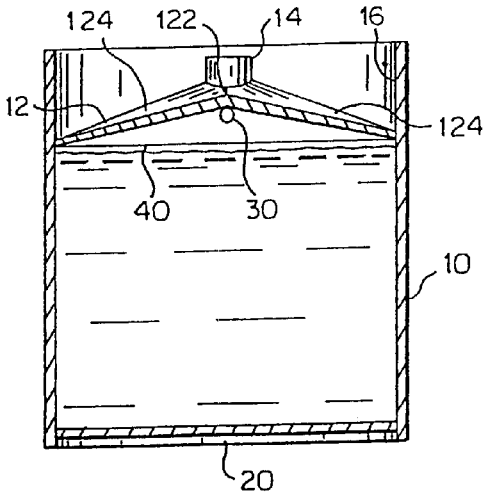
FIG. 3 shows a vertical cross-section through lines 3—3 of the container of FIG. 1.
Figure 4:
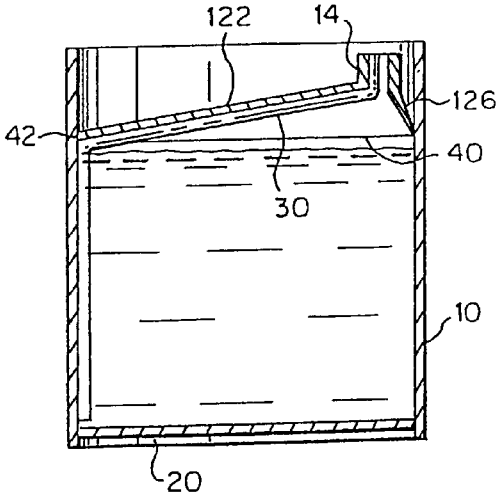
FIG. 4 shows a vertical cross-section through lines 4—4 of the container of FIG. 1.
Figure 5:
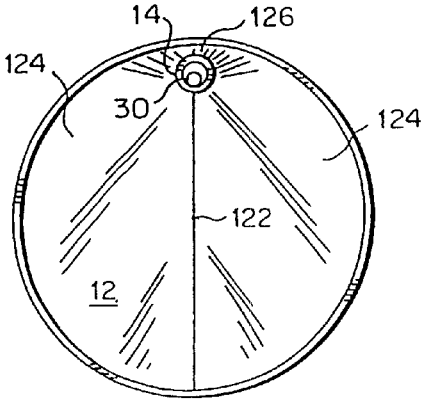
FIG. 5 shows a top plan view of the container of FIG. 1.

Referring to FIGS. 2–4, it can be clearly seen that the ridge 122 is inclined from the point of intersection 42 of the cover 12 with the wall 16 farthest from the bung 14, toward the bung 14. There is necessarily a larger slope 126 down from the bung 14 to the side wall 16 closest to the bung 14. The bung 14 is positioned on the cover 12 as close as possible to the side wall 16 adjacent thereto.

An air tube 30 may be inserted in the container 11, as may be seen in FIGS. 3–6. The air tube 30 can be made of, for example, a plastic material, glass, metal or any other suitable material.

The air tube 30 is positioned on the back of the bung 14 (with the side nearest the side wall being the front) adjacent to the ridge, and directed toward the bottom 20 of the container 11 on the side diagonally opposite the bung 14. In a preferred embodiment, the air tube 30 is directed along the underside of the ridge 122 of cover 12 and down the side wall 16 below intersection point 12, toward the bottom 11. When in use, the air tube 30 allows air to enter the container 11 to replace air lost when the container is emptied, thereby decreasing the splashing effect. Further, the air tube 30 is arranged on the back of the aperture of the bung 14 so that when the container 11 is in an emptying position, liquid from the container does not enter or occlude the air tube 30. Inside the container 11, the opening of the air tube 30 should be spaced a short distance from the bottom 20 of the container 11, preferably from 0.1–1 inches.

Figure 6:
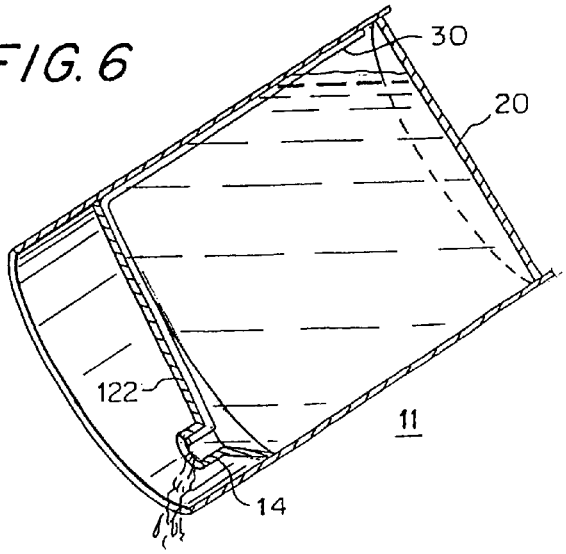
FIG. 6 shows a vertical cross-section showing the container of FIG. 1 in the course of emptying.
Figure 7:
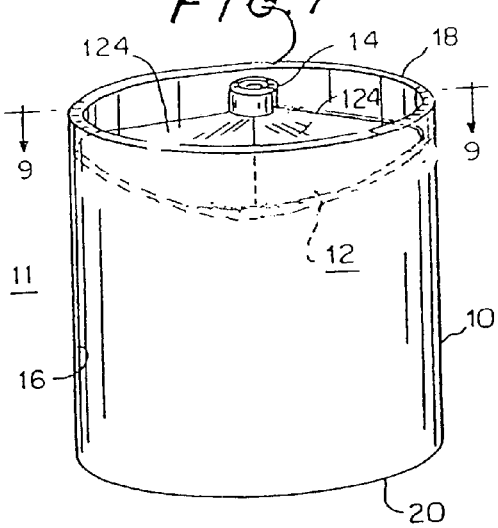
FIG. 7 shows a rear perspective view of a container according to a second embodiment of the present invention.

Reference will now be made to FIG. 6, showing a container 11 of the instant invention in the emptying position. The bung 14 is the lowest region of the inverted container 11 even as the container 11 deviates from an optimum emptying position. When the container is totally inverted, when seeking to remove the last residue of liquid from the container, the crease or ridge 122 in the cover 12 and the positioning of the bung 14 will allow every last drop to drip out with no place for a residue to be caught or remain, and without the necessity of shaking the container or tilting it here and there to force out as much residue as possible. It will be further appreciated that the opening of the air tube 30 adjacent to the bottom 20 of the container 11 is not immersed in fluid, nor is the opening of the air tube 30 in the bung 14 covered with pouring fluid, allowing air to enter and pass through to the bottom 20.

Figure 10:
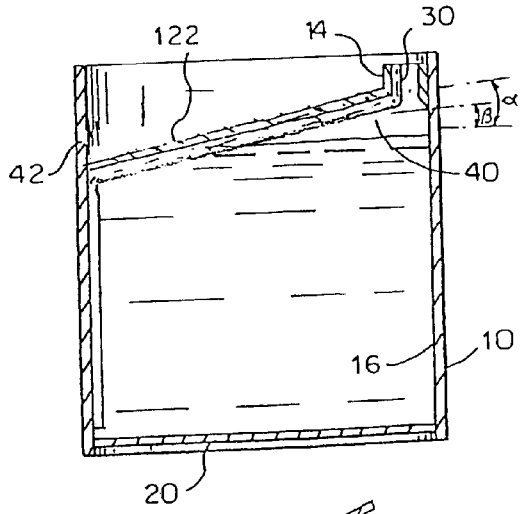
FIG. 10 shows a vertical cross-section through lines 10—10 of the container of FIG. 7.
Figure 11:
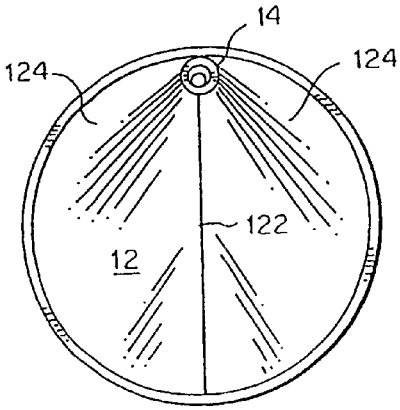
FIG. 11 shows a top plan view of the container of FIG. 7.
Figure 12:
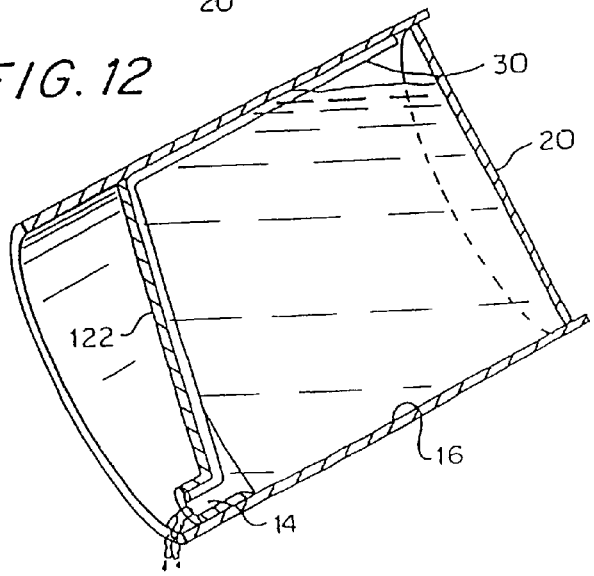
FIG. 12 shows a vertical cross-section showing the container of FIG. 7 in the course of emptying.

FIGS. 7–12 show another embodiment of the present invention. Like numbers are used for corresponding elements of the two embodiments. The second embodiment differs from the first in that the intersection 40 of the cover 12 with the side wall 16 lies in a plane which is sloped from the horizontal. As can be seen in FIG. 10, the slope of the intersection 40 may be at an angle β to the horizontal with the highest point (when the container is standing upright) at the edge where the bung adjoins the rim, and the lowest point diametrically opposite. The slope may be from about 1–10°, preferably about 1–5°. Additionally, the lid has an offset dome shape, as in the embodiment of FIGS. 1–6, with a crease or ridge 122 running from the bung 14 to the diametrically opposite side of the cover 12. The angle a of the ridge 122 is preferably about 1–5° greater than the angle β.

Figure 8:
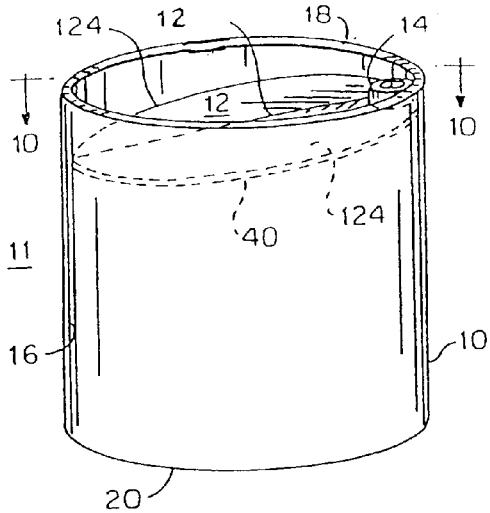
FIG. 8 shows a side perspective view of the container of the embodiment of FIG. 7.
Figure 9:
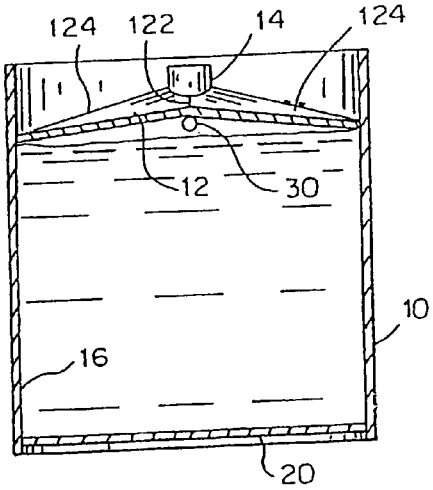
FIG. 9 shows a vertical cross-section through lines 9—9 of the container of FIG. 7.

As shown in FIGS. 8 and 10, because the plane of the intersection 40 is sloped, it is easier to arrange for the bung 14 to be adjoining the side wall 16, although it is possible in the first embodiment for the bung 14 to be adjacent the wall 16 and in the second embodiment for the bung 14 to be very slightly spaced from the wall 16. All of these arrangements are included in the present invention.

Figure 13:
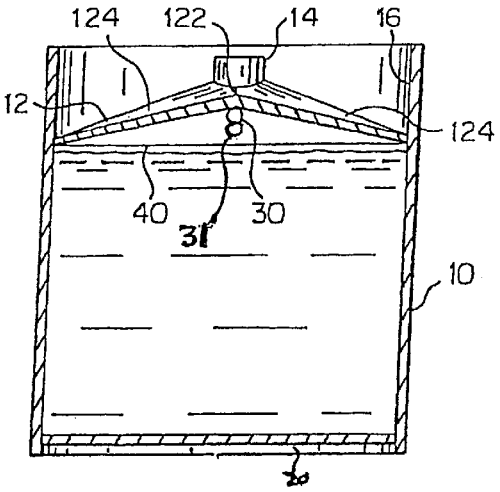
FIG. 13 shows a vertical cross-section of a container according to a further embodiment of the present invention.
Figure 14:
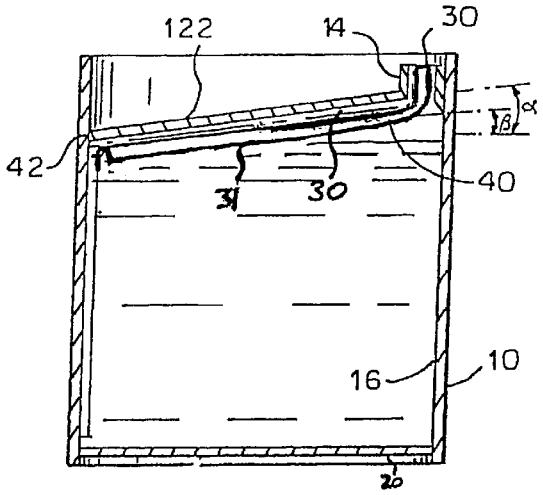
FIG. 14 shows a vertical cross-section of the container of FIG. 13 at an angle of 90° from the cross-section of FIG. 13.

Reference is now made to FIGS. 13 and 14 showing an embodiment wherein the container contains two tubes, a short tube 31 and the longer tube 30. The short tube 31 is directed toward the area of the intersection of the cover 12 with the side wall 10 furthest from the bung 14. This embodiment may be used in any cover embodiment of the present invention, including both the embodiments of FIGS. 1–6 and that of FIGS. 7–12.

Figure 15:
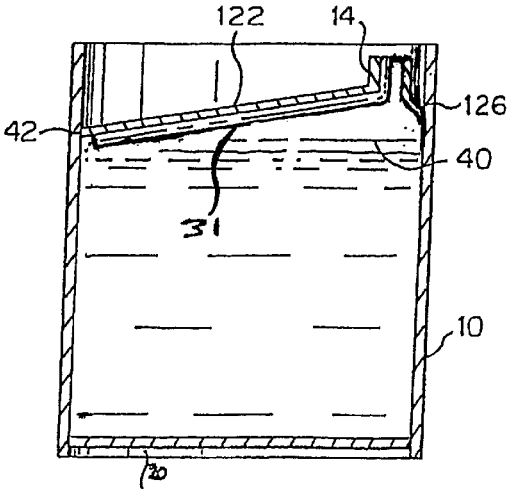
FIG. 15 shows a vertical cross-section of a container according to yet another embodiment of the present invention.

FIG. 15 shows an embodiment wherein the sole tube is a short tube 31 directed toward the area of the intersection of the cover 12 with the side wall 10 furthest from the bung 14. This embodiment may also be used in any cover configuration of the present invention, including both the embodiments of FIGS. 1–6, and that of FIGS. 7–12.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention. Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A container, comprising:

a body having side walls and a bottom, wherein said side walls terminate at an upper rim;

a cover connected to said side walls and having a bung therein adjacent a side wall, wherein said cover is shaped such that the aperture of the bung is at the highest point of the cover when the container is upright and wherein said cover has a ridge therein running from the bung to the wall diametrically opposite the bung, said cover having a downward slope on either side of said ridge to the line of intersection of the cover with the side walls.

2. A container in accordance with claim 1, wherein said cover intersects with said side walls in a horizontal plane when the container is upright.

3. A container in accordance with claim 1, wherein said cover intersects with said side walls in a plane which is at an angle to the horizontal, when the container is upright, with the bung being adjacent the side wall at the highest point of intersection of said cover with said side wall.

4. A container in accordance with claim 3, wherein the plane of intersection of said cover with said side walls is at an angle of about 1–10° with the horizontal when the container is upright.

5. A container in accordance with claim 4, wherein said ridge is at an angle with the horizontal which is about 1–5° greater than said angle with the horizontal of the plane of intersection of said cover with said side walls.

6. A container in accordance with claim 1, further including an air tube disposed so as to run from the aperture of said bung to a point on the interior of said container near the point of intersection of said side walls with said bottom which is farthest from said bung.

7. A container in accordance with claim 6, wherein said air tube is disposed in the aperture of said bung on the side thereof farthest from the point at which the said bung is nearest said side wall.

8. A container in accordance with claim 6, further including a second air tube disposed so as to run from the aperture of said bung to a point on the interior of said container near the point of intersection of said side walls with said cover which is farthest from said bung.

9. A container in accordance with claim 1, wherein said ridge is at an angle of about 1–10° with the horizontal when the container is upright.

10. A container in accordance with claim 1, wherein said cover is connected to said side walls below the upper rim thereof.

11. A container in accordance with claim 1 further including an air tube disposed so as to run from the aperture of said bung to a point on the interior of said container near the point of intersection of said side walls with said cover which is farthest from said bung.

* * * * *